US006396211B1

(12) United States Patent
Satori

(10) Patent No.: US 6,396,211 B1
(45) Date of Patent: May 28, 2002

(54) MICROWAVE DISCHARGE TYPE ELECTROSTATIC ACCELERATOR HAVING UPSTREAM AND DOWNSTREAM ACCELERATION ELECTRODES

(75) Inventor: Shin Satori, Hokkaido (JP)

(73) Assignee: Advanced Technology Institute, Ltd., Hokkaido (JP)

( * ) Notice: Subject to any disclaimer, the term of this patent is extended or adjusted under 35 U.S.C. 154(b) by 0 days.

(21) Appl. No.: 09/616,541

(22) Filed: Jul. 14, 2000

(30) Foreign Application Priority Data

Jun. 3, 2000 (JP) ..... 2000-060533

(51) Int. Cl.[7] ..... H01J 7/24

(52) U.S. Cl. ..... 315/111.01; 315/111.81; 313/231.31

(58) Field of Search ..... 315/111.01, 111.21, 315/111.41, 111.61, 111.71, 111.81, 111.91; 313/230, 231.31

(56) References Cited

U.S. PATENT DOCUMENTS 3,634,704 A * 1/1972 Stix ..... 315/111.01
5,973,447 A * 10/1999 Mahoney et al. ..... 313/359.1

* cited by examiner

*Primary Examiner*—Don Wong
*Assistant Examiner*—Thuy Vinh Tran
(74) *Attorney, Agent, or Firm*—Knobbe, Martens, Olson & Bear, LLP

(57) ABSTRACT

A microwave discharge-type electrostatic accelerator propulsion device is provided that features a simplified system configuration, and accordingly, high reliability and low fabrication costs. A discharge chamber is formed by side walls that are made of an insulating material. An upstream acceleration electrode and a ring-shaped downstream acceleration electrode, which are supplied with power by an acceleration power supply, are provided upstream and downstream of the discharge chamber, respectively.

7 Claims, 2 Drawing Sheets

MICROWAVE DISCHARGE TYPE ELECTROSTATIC ACCELERATOR HAVING UPSTREAM AND DOWNSTREAM ACCELERATION ELECTRODES

BACKGROUND OF THE INVENTION

1. Field of the Invention

The present invention relates to a rocket propulsion device referred to as electric propulsion for use in the orbital attitude control of an artificial satellite or as the main propulsion of a planetary exploration mission, and more particularly to an electrostatic accelerator propulsion device of a type that can obtain propulsion as the reaction of accelerating ions in an electrostatic field.

2. Description of the Related Art

FIG. 1 shows an example of the above-described electrostatic accelerator propulsion device of the prior art. The electrostatic accelerator propulsion device comprises gas tank 101, main discharge chamber 107, acceleration electrodes 108, and neutralizer 110. Propellant supplied from gas tank passes through gas feeder 103 and isolators 104 by way of feedlines 102, and is supplied to main discharge chamber 107 and neutralizer 110. In main discharge chamber 107, propellant in a gaseous state undergoes electrolytic dissociation by direct-current discharge, high-frequency discharge, or microwave discharge, thereby generating plasma 106. In the case of microwave discharge, for example, plasma is generated by supplying microwaves that are generated at microwave power supply 114 to main discharge chamber 107 via impedance matching circuit 105, which is constituted by a waveguide or antenna, and then carrying out discharge. Isolators 104 are provided to prevent dielectric breakdown both between main discharge chamber 107 and gas feeder 103 and between neutralizer 110 and gas feeder 103. Neutralizer 110 emits electrons 112 from an orifice to electrically neutralize positive ions 113 that are emitted from acceleration electrode 108.

Direct-current voltage is applied to acceleration electrode 108 by acceleration power supply 109, positive ions 113 within the plasma are accelerated to a high speed by the electrostatic field that is generated between the electrodes, and propulsion is generated as a reaction to this acceleration.

Plasma 111 in neutralizer 110 is generated by direct-current discharge, high-frequency discharge, or microwave discharge, and electron current 112 is emitted from the orifice provided downstream to electrically neutralize the ion beam.

The electrostatic accelerator propulsion device of the type is described on page 937 of "Aeronautics & Space", Second Edition (Sep. 30, 1992, Maruzen Publishing).

Typically, electrostatic accelerator propulsion devices of the prior art have been complicated systems requiring a plurality of power supplies, such as a power supply for plasma generation and a power supply for positive ion acceleration, and fabrication costs were excessive. In addition, the electrodes had to be installed with extremely small gaps, and the accuracy of this installation had a large effect on the performance of the propulsion device.

Regarding large-scale electric propulsion devices of the prior art having a diameter of 20 centimeters or more, the direct-current discharge type exhibits the best propulsion performance of current electric propulsion devices, but if size and power are reduced, the proportion of ion loss is relatively great and the addition of plasma 106 and maintaining discharge are therefore problematic. The presence of an antenna as impedance matching circuit 105 inside main discharge chamber 107 has the advantage of enabling generation of a high-density plasma, but suppressing wear and tear on the antenna due to ion sputtering has been problematic. Furthermore, the drop in performance due to the propellant that is supplied to neutralizer 110, which makes no direct contribution to propulsion, cannot be ignored. Use of electromagnetic valves of the prior art in the valves in gas feeder 102 and isolator 104 results in power consumption that, when compared with the electric power for generating propulsion, cannot be ignored.

SUMMARY OF THE INVENTION

It is an object of the present invention to provide a microwave discharge-type electrostatic accelerator propulsion device having a simplified system configuration, higher reliability, lower fabrication cost, and furthermore, that eases the need for accuracy when installing electrodes.

It is another object of the present invention to provide a microwave discharge-type electrostatic accelerator propulsion device that reduces damage to an antenna due to wear and tear on electrodes.

It is another object of the present invention to provide a microwave discharge-type electrostatic accelerator propulsion device in which a neutral plasma need not be generated and in which excessive propellant need not be supplied.

It is another object of the present invention to provide a microwave discharge-type electrostatic accelerator propulsion device in which the power supply is made more compact.

It is another object of the present invention to provide a microwave discharge-type electrostatic accelerator propulsion device in which acceleration electrodes have a simple construction.

It is another object of the present invention to provide a microwave discharge-type electrostatic accelerator propulsion device in which stable plasma generation is possible even at low power.

It is another object of the present invention to provide a microwave discharge-type electrostatic accelerator propulsion device in which the propellant supply system is more compact.

In the microwave discharge-type electrostatic accelerator propulsion device according to the present invention, the inner walls of the discharge chamber are made of an insulating material, and the acceleration electrode that accelerates positive ions within the plasma consists of an upstream acceleration electrode and a downstream acceleration electrode that form an electrostatic field between the electrodes, provided upstream and downstream of the discharge chamber, respectively.

Since electric potential is applied between the two electrodes that are provided upstream and downstream of the discharge chamber using a single power supply, fewer power supplies are required for ion acceleration than in electrostatic accelerator propulsion devices of the prior art. Moreover, since the accuracy demanded in installing the electrodes is greatly eased, not only is the system configuration simplified and reliability increased, but fabrication costs are also reduced. In addition, since the electrodes are provided upstream and downstream of the discharge chamber, the inner walls of the discharge chamber must be an insulating material.

According to an embodiment of the present invention, the antenna for emitting microwaves inside the discharge chamber is a plate antenna that is formed by a pattern on a printed substrate. Since the antenna is a plate antenna formed by a pattern on a printed substrate and not a cylindrical dipole antenna, damage to the antenna caused by wear of the electrodes is greatly reduced and the durability of the propulsion device can be greatly improved.

According to an embodiment of the present invention, a cold cathode is used as a neutralizer. Accordingly, there is no need to generate a neutral plasma or to supply extra propellant, and the drop in performance attendant to a smaller rocket propulsion device can be remedied.

According to an embodiment of the present invention, the antenna is of a circuit construction in which it is arranged on the same substrate as a microwave matching circuit, a microwave amplification circuit, and a microwave oscillator constituted by microstrip lines. In other words, since a portion of the power supply is attached to the engine side (because it is mounted on the engine substrate), miniaturization of the power supply is facilitated, the entire rocket propulsion device can be produced as a unit, and it becomes possible to apply the invention to a clustered configuration with a plurality of microwave discharge-type electrostatic accelerator propulsion devices.

According to an embodiment of the present invention, the antenna is also used as the upstream electrode for ion acceleration. As a result, the acceleration electrode has a simpler construction, the number of parts can be decreased, and the reliability of the rocket propulsion device can be improved.

According to an embodiment of the present invention, a plasma ignition device is provided in the discharge chamber. Accordingly, the critical value of the microwave power density for generating plasma can be lowered, the plasma can be reliably ignited, discharge (plasma) can be maintained even at low power, reliable and stable plasma generation can be achieved, and microwave leakage (EMI [Electromagnetic Interference]) that accompanies defective plasma ignition can be eliminated.

According to an embodiment of the present invention, a device for preventing discharge in the gas flow path (isolator) that is formed by micro-machining methods and a portion of propellant supply device that is composed of a microvalve are provided on the same substrate as the antenna and microwave circuit. As a result, miniaturization of the propellant supply system is facilitated and the entire rocket propulsion device can be realized as a unit, thereby enabling application to a clustered construction that uses a plurality of microwave discharge-type electrostatic accelerator propulsion devices.

The above and other objects, features, and advantages of the present invention will become apparent from the following description based on the accompanying drawings which illustrate examples of preferred embodiments of the present invention.

DETAILED DESCRIPTION OF THE PREFERRED EMBODIMENTS

Figure 1:
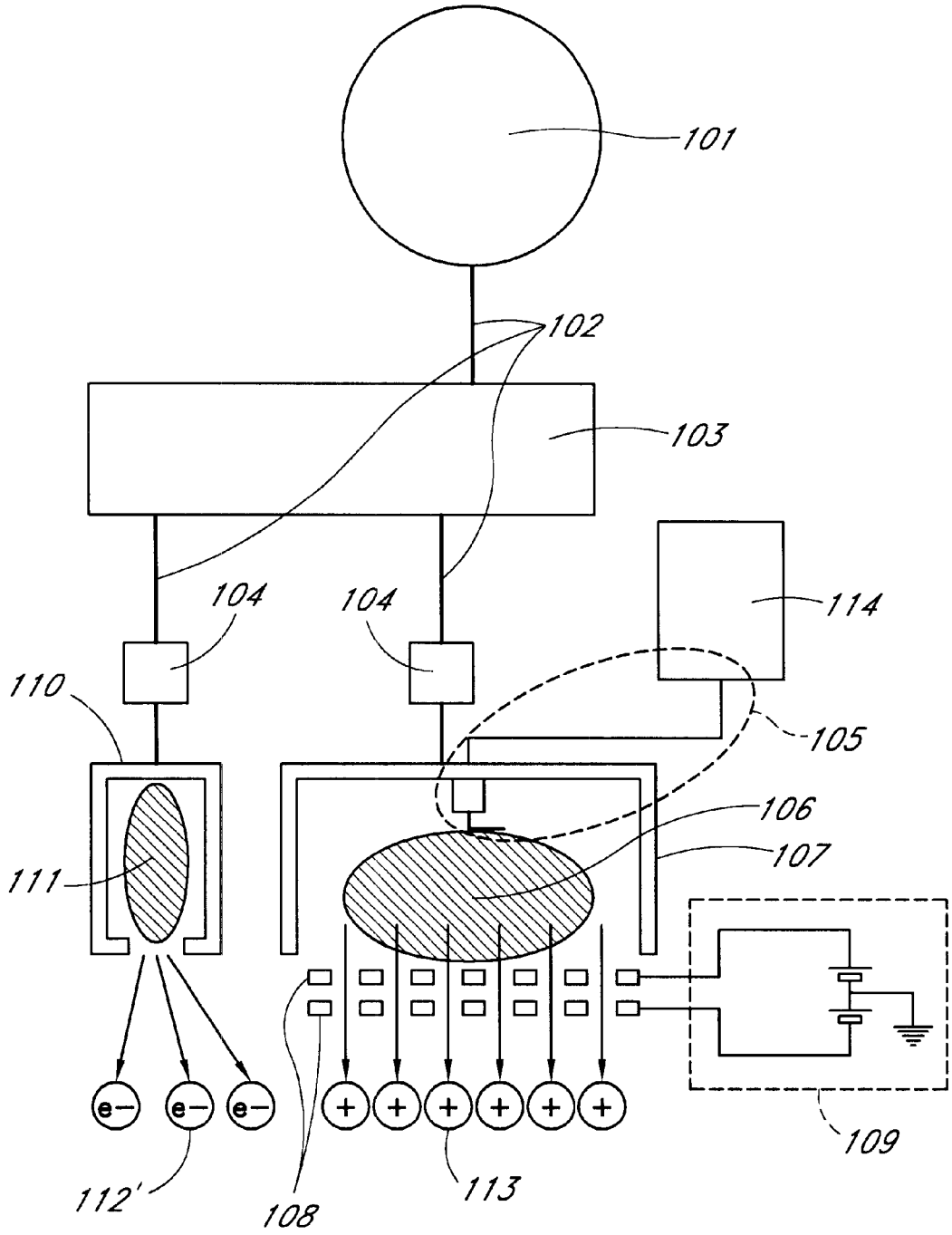
FIG. 1 (PRIOR ART)
FIG. 1 is a vertical section of a electrostatic accelerator propulsion device (ion engine) of the prior art.
Figure 2:
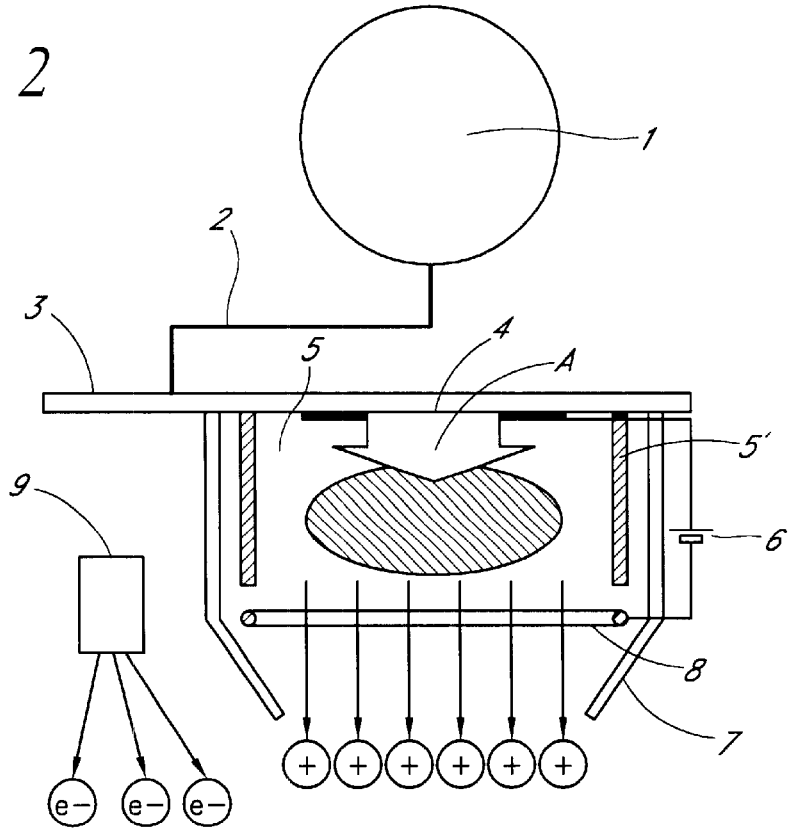
FIG. 2 is a vertical section of the microwave discharge-type electrostatic accelerator propulsion device according to an embodiment of the present invention.
Figure 3:
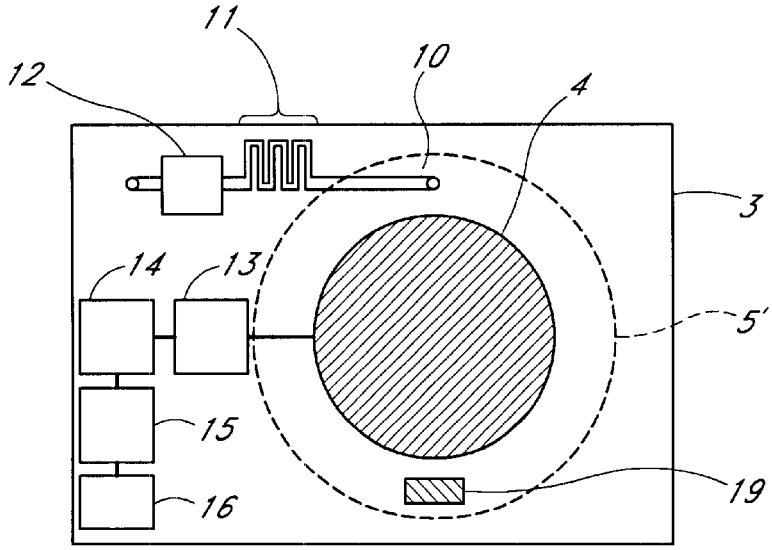
FIG. 3 shows the arrangement of components of the uppermost flow surface of the acceleration propulsion device of FIG. 2.

Referring now to FIG. 1, there is shown a vertical section of the microwave discharge-type electrostatic accelerator propulsion device according to an embodiment of the present invention. FIG. 2 shows the arrangement of components on the uppermost flow surface of this device.

Discharge chamber 5 is formed by side walls 5', which are made of an insulating material. Discharge chamber 5 is shielded by shield case 7. Upstream acceleration electrode 4 and ring-shaped downstream acceleration electrode 8, both electrodes 4 and 8 being supplied with power by acceleration power supply 6, are provided upstream and downstream of discharge chamber 5, and plasma ignition device 9 is provided inside discharge chamber 5. Microwave antenna 4 for emitting microwaves A inside discharge chamber 5 is a plate-shaped antenna formed by a patch antenna, a metal plate, and a pattern on a printed substrate and also serves as upstream acceleration electrode 4. This microwave antenna 4 is arranged on the same circuit substrate 3 with microwave oscillator 16 constituted by microstrip lines, microwave amplifier 15, microwave matching circuit 14, and DC cutter (a device for eliminating the direct-current component) 13. A portion of propellant supply device composed of orifice 10, microvalve 12, and isolator 11 formed by micro-machining methods is also mounted on circuit substrate 3. Cold cathode 9 is provided as a neutralizer. In addition to the above-mentioned components, the propellant supply device includes feedlines, propellant introduction and exhaust valves, a pressure adjustment valve (or a pressure adjustment device), and supports.

Propellant that is supplied via feedlines 2 from gas tank 1, which is filled with propellant, passes through microvalve 12, isolator 11, and orifice 10 on circuit substrate 3 and is supplied into discharge chamber 5. Microwaves are generated by a microwave circuit that is made up of DC cutter 13, matching circuit 14, amplifier 15, and oscillator 16; the microwaves are supplied to microwave antenna/upstream acceleration electrode 4; and microwaves A are supplied into discharge chamber 5. The plasma is ignited by plasma ignition device 19 and the supplied microwaves, and the plasma is maintained by the supplied microwaves. Ions from the plasma are accelerated by the electric field that is formed by microwave antenna/upstream acceleration electrode 4 and downstream acceleration electrode 8, and thrust is obtained by the emission of ions. In addition, the emitted ions are neutralized by electrons emitted from cold cathode 9.

While a preferred embodiment of the present invention has been described using specific terms, such description is for illustrative purposes only, and it is to be understood that changes and variations may be made without departing from the spirit or scope of the following claims.

What is claimed is:

1. A microwave discharge-type electrostatic accelerator propulsion device comprising:

a gas tank filled with propellant;

a discharge chamber having an upper end, a lower end, and side walls, wherein (i) propellant is supplied at the upper end from the gas tank, (ii) the lower end is opened from which accelerated positive ions are ejected, and (iii) insulation inner walls are disposed along the side walls;

an antenna disposed at the upper end for discharging microwaves inside the discharge chamber and thereby generating a plasma from the propellant;

a plasma ignition device for igniting the plasma;

an upstream acceleration electrode, as a negative electrode, disposed inside the discharge chamber at the upper end;

a downstream acceleration electrode, as a positive electrode, disposed inside the discharge chamber at the lower end;

an acceleration power supply for supplying a power voltage between the upper acceleration electrode and the downstream acceleration electrode to generate an electrostatic field therebetween in the plasma, thereby accelerating positive ions toward the downstream acceleration electrode; and a neutralizer disposed outside the discharge chamber for emitting electrons to electrically neutralize the positive ions passing through the downstream acceleration electrode.

2. A microwave discharge-type electrostatic accelerator propulsion device according to claim 1, wherein said antenna is a plate antenna formed by a pattern on a printed substrate.

3. A microwave discharge-type electrostatic accelerator propulsion device according to claim 2, wherein said antenna is of a circuit construction in which it is arranged on the same substrate as a microwave oscillator constituted by microstrip lines, a microwave amplification circuit, and a microwave matching circuit.

4. A microwave discharge-type electrostatic accelerator propulsion device according to claim 3, wherein a portion of the propellant supply device, which is composed of a microvalve and a device for preventing discharge within the gas current that are formed by micro-machining methods, is mounted on the same substrate with said antenna and microwave circuits.

5. A microwave discharge-type electrostatic accelerator propulsion device according to claim 2, wherein said plate antenna also serves as said upstream electrode.

6. A microwave discharge-type electrostatic accelerator propulsion device according to claim 1, wherein said plasma ignition device is provided inside said discharge chamber.

7. A microwave discharge-type electrostatic accelerator propulsion device according to claim 1, wherein a cold cathode is used as said neutralizer.

* * * * *

UNITED STATES PATENT AND TRADEMARK OFFICE

CERTIFICATE OF CORRECTION

PATENT NO. : 6,396,211 B1
DATED : May 28, 2002
INVENTOR(S) : Shin Satori

It is certified that error appears in the above-identified patent and that said Letters Patent is hereby corrected as shown below:

Title page,
Item [30], Foreign Application Priority Date, delete "June 3, 2000" and insert -- March 6, 2000 --.

Signed and Sealed this

Twenty-sixth Day of November, 2002

*Attest:*

*Attesting Officer*

JAMES E. ROGAN
*Director of the United States Patent and Trademark Office*